US006649854B1

(12) United States Patent
Bauer et al.

(10) Patent No.: US 6,649,854 B1
(45) Date of Patent: Nov. 18, 2003

(54) VACUUM CONTACTOR WITH MOVABLE GUIDE ELEMENT

(75) Inventors: Johann Bauer, Ebermannsdorf (DE); Hans Brandl, Maxhuette-Haidhof (DE); Markus Meier, Rieden (DE); Peter Schlegl, Altdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/148,290

(22) PCT Filed: Nov. 24, 2000

(86) PCT No.: PCT/DE00/04175

§ 371 (c)(1),
(2), (4) Date: May 29, 2002

(87) PCT Pub. No.: WO01/43152

PCT Pub. Date: Jun. 14, 2001

(30) Foreign Application Priority Data

Dec. 8, 1999 (DE) ..... 199 59 207

(51) Int. Cl.[7] ..... H01H 33/66
(52) U.S. Cl. ..... 218/120; 218/140; 218/154
(58) Field of Search ..... 218/118, 120, 218/140, 155, 124, 153, 154, 135

(56) References Cited

U.S. PATENT DOCUMENTS 3,941,959 A * 3/1976 Kohler et al. ..... 218/140
4,434,331 A * 2/1984 Sakuma et al. ..... 335/151
4,527,028 A * 7/1985 Luehring ..... 218/119
4,933,518 A * 6/1990 Yin ..... 218/134
5,004,877 A * 4/1991 Yin ..... 218/124
5,543,598 A * 8/1996 Duffour et al. ..... 218/135
5,864,108 A * 1/1999 Rohling et al. ..... 218/134

FOREIGN PATENT DOCUMENTS

| | | |
|---|---|---|
| DE | 2 202 186 | 7/1973 |
| DE | 197 21 611 A1 | 11/1998 |
| DE | 198 33 484 A1 | 6/1999 |
| DE | 198 50 202 A1 | 4/2000 |
| EP | 0 641 001 A1 | 3/1995 |

OTHER PUBLICATIONS

O. Richter et al.: "Bauelemente Der Feinmechanik" *Verlagt Technik Berlin*, 183–195, 1952.

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

A vacuum contactor includes a stationary contact and a moving contact, which can be moved in order to produce a current-carrying connection. In order to guide the moving contact during its movement in the enclosure, at least one guide element, which can be moved in a groove, is provided on the moving contact.

41 Claims, 3 Drawing Sheets

VACUUM CONTACTOR WITH MOVABLE GUIDE ELEMENT

This application is the national phase under 35 U.S.C. §371 of PCT International Application No. PCT/DE00/04175 which has an International filing date of Nov. 24, 2000, which designated the United States of America, and which claimed priority on German Application No. 199 59 207.1 filed Dec. 8, 1999, the entire contents of which are hereby incorporated by reference.

FIELD OF THE INVENTION

The invention generally relates to a switching device which is in the form of a vacuum contactor. More preferably, it relates to one which includes a contact (stationary contact for example) which is fixed to the enclosure, and a contact (loose bearing for example) which can be moved in order to produce a current-carrying connection.

BACKGROUND OF THE INVENTION

Vacuum contactors are known as prior art, in which a sleeve is fitted on the loose bearing, and which slide on a pin which is fixed to the enclosure. Furthermore, vacuum contactors are known in which a guide ring is provided on the vacuum interrupter.

In this configuration, the interrupter bolt which produces the contact slides into this ring. The guide ring can in this case be arranged on the stationary side or on the loose bearing side.

EP 0 641 001 A1 discloses a switch having a vacuum interrupter, in which a contact support, which can be moved by a drive, of a moving switching element is held on an interrupter axis in a vacuum tight manner via a folding bellows and via a sliding guide, and is passed out of the switch enclosure.

The described switch has a guide groove 22 which is held in an integral bush 12, which in turn merges into a mounting flange 13. This is attached via screw connections 15 to a flange 16 of the enclosure 7 of the switch. In order to remove the moving contact support 8 of the switch, the screw connections 15 must be undone, and the mounting flange 13 must be pulled off the enclosure 7.

SUMMARY OF THE INVENTION

An embodiment of the invention is based on an object of offering a vacuum contactor with a moving contact guide such as a loose bearing guide, which is more convenient to operate.

Contactors are switching devices and are used, for example, for switching motors. The contactors may be in the form of air contactors or vacuum contactors.

The vacuum switching device, vacuum contactor for short, according to an embodiment of the invention for opening and closing circuits, has movable contact such as a loose bearing for example, with at least one guide element which is guided in a groove (recess) in the enclosure of the vacuum contactor and is moved during operation of the loose bearing. The loose bearing is in this way held and guided in the enclosure with a high level of repeatability accuracy and such that it is resistant to disturbances and faults.

In this case, the guide element can be fitted on a spring mount of a compression spring for producing additional contact pressure from the loose bearing on the stationary contact, as a result of which the spring mount has two functions.

If the guide element is fitted on an annular element which is arranged adjacent to the bellows element, and is thus fitted close to the contact point of the loose bearing, this results in the loose bearing being guided in a particularly reliable manner.

In order to further improve the guidance characteristics of the loose bearing, a number of, for example opposite, guide elements may also be provided on the spring mount and/or on an annular element. A simplified design configuration of the vacuum contactor is achieved if the annular element has not only a guide element fitted to it, but also an indicator for indicating the movement position of the loose bearing (closed/open) and/or a projection for positioning of an angled element for fitting a flexible strip on the loose bearing.

Guide elements which are essentially cuboid can be produced at low cost. In principle, the geometry of the guide element and of the corresponding groove (guide groove) for producing an interlock are matched to one another, and their cross sections can be matched to the respectively required load profile and may, for example, also be triangular or semicircular.

In this case, the term groove is intended to mean a recess of any type. The groove or grooves for holding the guide element or guide elements may be produced, for example, as molded recesses/depressions in the enclosure of the vacuum contactor or as recesses/depressions produced in some other way by forming, material cutting or material compressing manufacturing methods.

According to an embodiment of the invention, the groove for holding the guide element is formed by the interaction of the (fitted) cover of the enclosure with the lower part of the enclosure, so that when the enclosure is open and the cover is removed, the loose bearing can be removed conveniently from the enclosure (from above), for example for repair or for replacement of the vacuum interrupter.

BRIEF DESCRIPTION OF THE DRAWINGS

Further details of the invention will become evident from the exemplary embodiments in the FIGS. of the drawings, in which.

DETAILED DESCRIPTION OF THE PREFERRED EMBODIMENTS

When actuating three-phase motors, the individual phases are connected and disconnected separately, and the associated vacuum interrupters which are used for this purpose are normally located in enclosures with enclosure chambers arranged adjacent to one another, for holding the individual vacuum interrupters.

Figure 1:
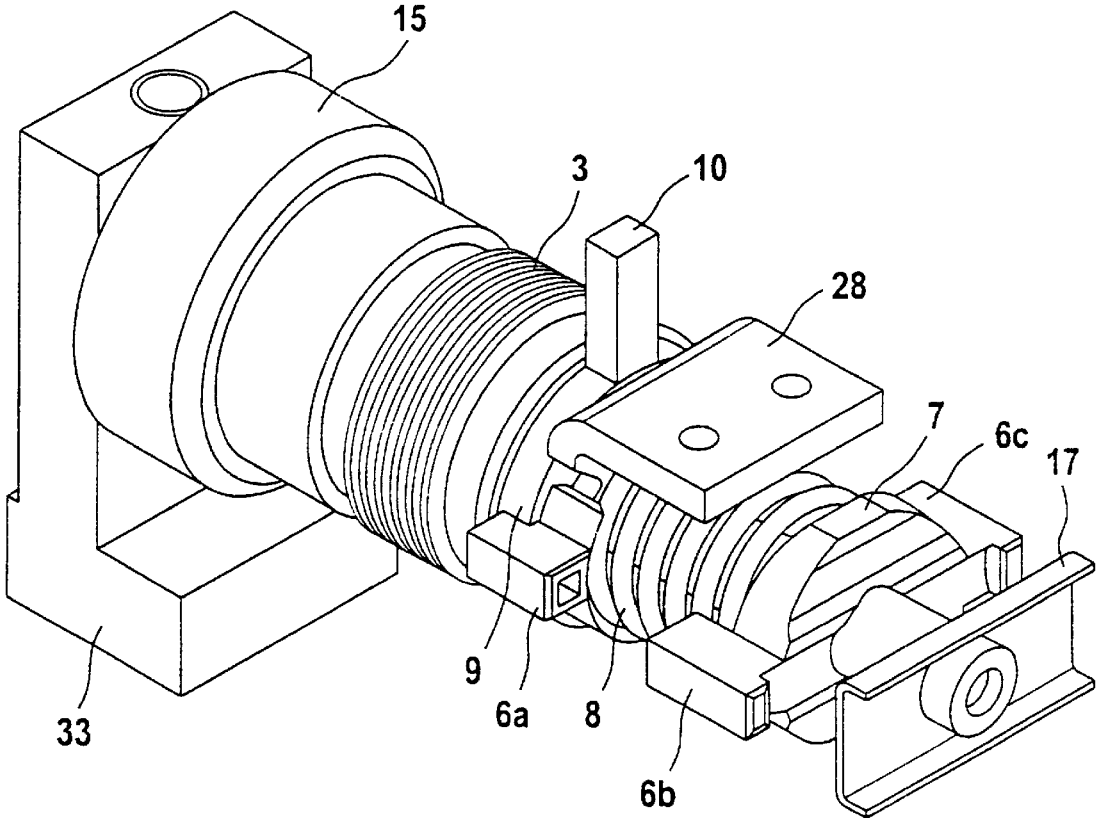
FIG. 1 shows a perspective overall view of a vacuum contactor (interrupter assembly, current path) without an enclosure.

In this case, a single interrupter assembly is accommodated in each enclosure chamber, as shown in FIG. 1. The interrupter assembly shown in FIG. 1 has a stationary bearing 33 with a stationary contact 1 fitted to it, as shown in FIG. 2.

The interrupter 15 is fitted to the stationary bearing 33 and the bolt 16 of the loose bearing 2 (see FIG. 2) is located in it. The interrupter 15 with the bellows element 3 is followed by the annular element 9 with an indicator 10, the angled element 28 and the compression spring 8, which is held in the spring mount 7. The lever 23 as shown in FIG. 2 engages between the spring mount 7 and the lever mount 17 (not shown in FIG. 1).

Figure 2:
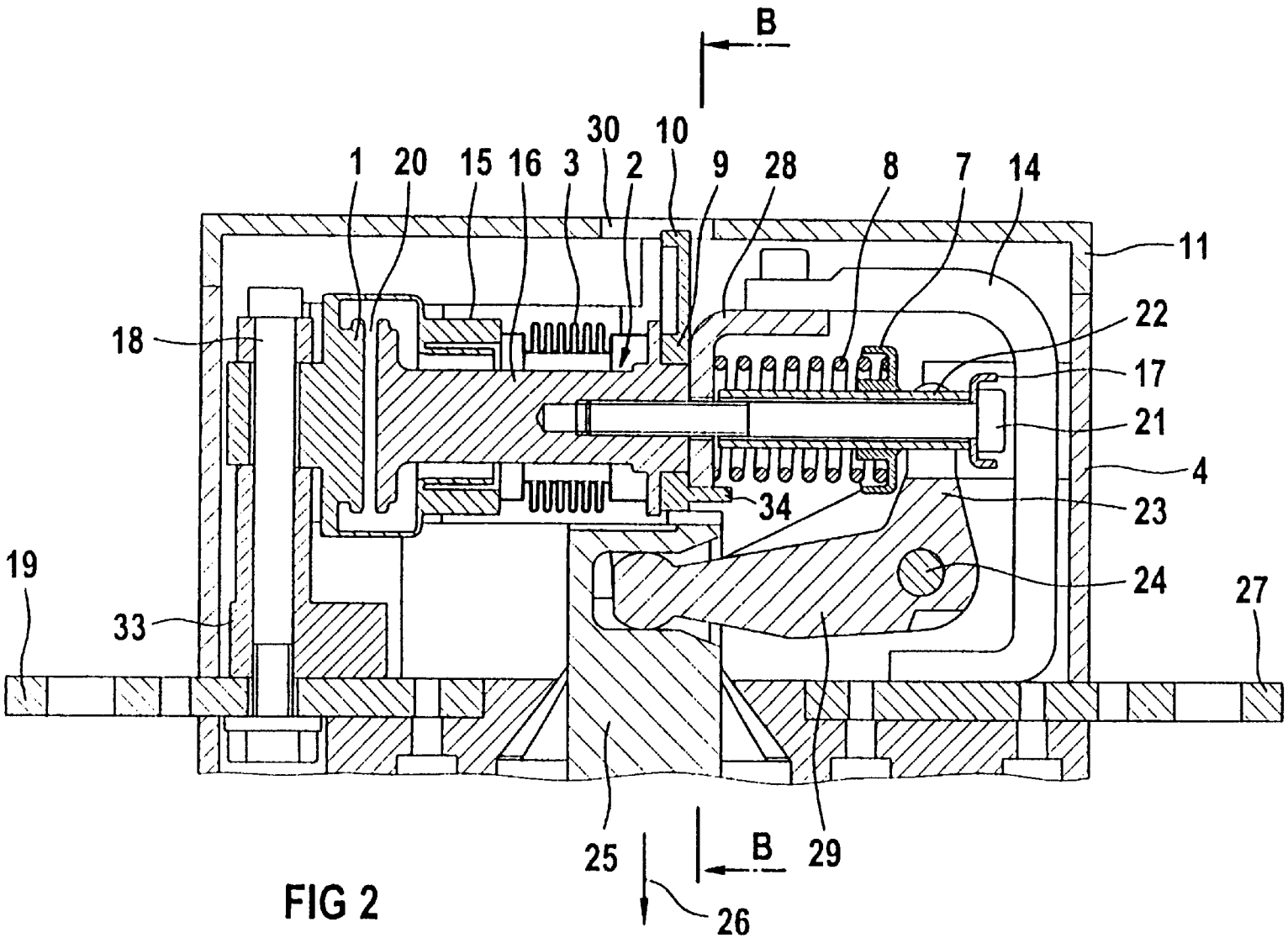
FIG. 2 shows a longitudinal section through the vacuum contactor shown in FIG. 1, with the surrounding enclosure.
Figure 3:
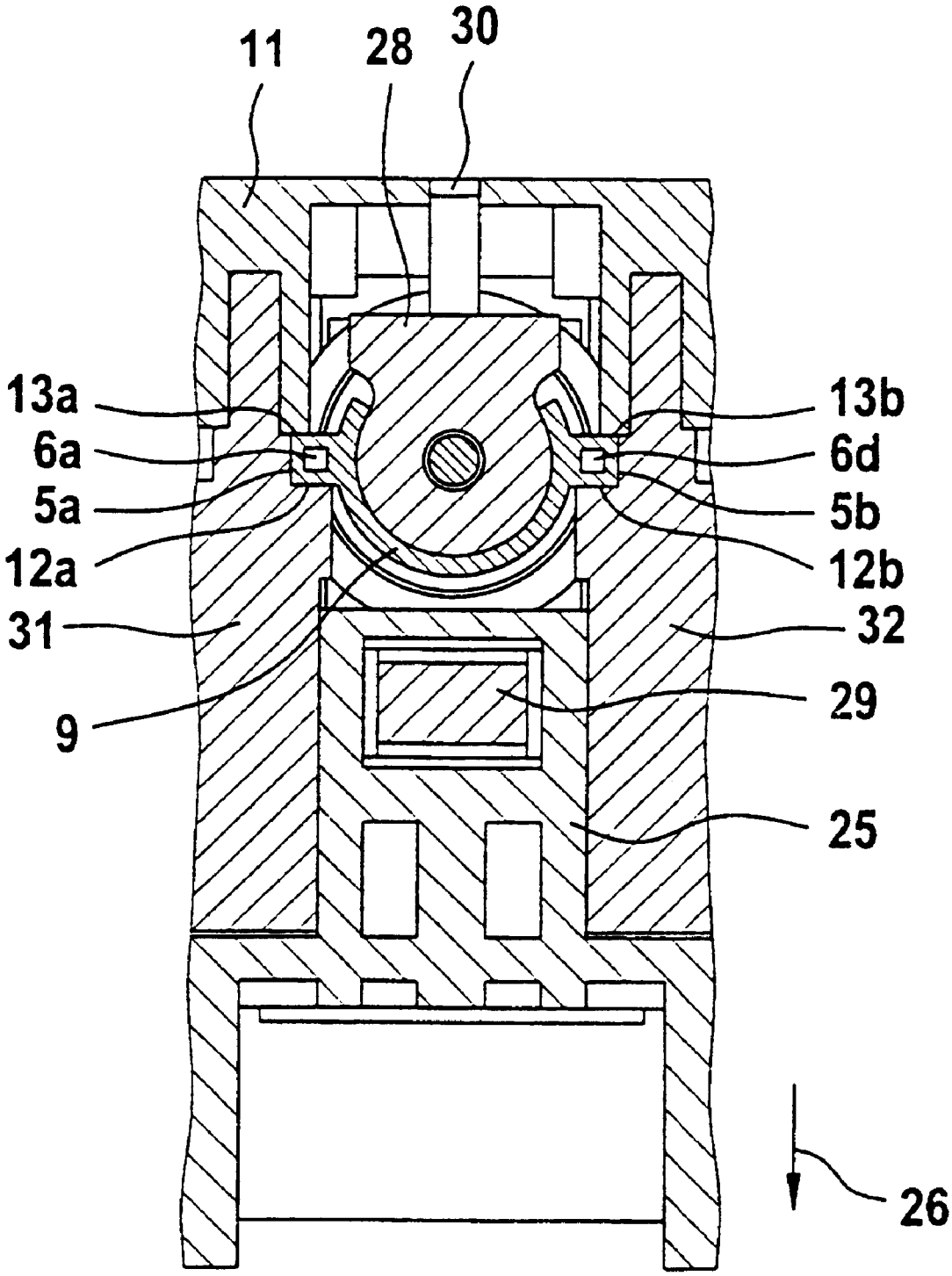
FIG. 3 shows a section B—B as shown in FIG. 2.

When the vacuum contactor is activated as shown in FIG. 1, the loose bearing 2 is moved in the interrupter 15 with the bellows element 3 and the compression spring 8 being compressed, as a result of which the guide elements 6a, 6b and 6c are moved and guided in the respectively corresponding grooves 5*a* and 5*b* (longitudinal grooves) in the adjacent enclosure walls 31 and 32 (see FIG. 2 and FIG. 3). The guide element 6d is located opposite the guide element 6a (see FIG. 3), and cannot be seen in FIG. 1.

As shown in FIG. 2, the stationary contact 1 is located on the stationary bearing 33 of the vacuum contactor and is conductively connected via the stationary bearing element 18 to the connecting rail 19 for the electrical current input.

FIG. 2 shows the vacuum contactor in the open switch position, with the bolt 16 of the loose bearing 2 being arranged in the interrupter 15 and in the bellows element 3 on the contact point 20, at a distance from the stationary contact 1.

The sleeve 22 and the angled element 28 are fitted to the bolt 16 via the attachment screw 21. The lever 23 of the lever element 29 is located between the lever mount 17 and the spring mount 7, and is held on the bearing element 24 such that it can rotate and, when the contact support 25 is operated in the movement direction 26, results in the vacuum contactor being closed by movement of the bolt 16 of the loose bearing 2 toward the stationary contact 1.

The angled element 28 is connected to the connecting rail 27 via the flexible strip 14. When the vacuum contactor is closed, there is an electrical connection between the connecting rail 19 and the connecting rail 27 via the stationary contact 1 and the loose bearing 2.

The loose bearing 2 is guided by the guide elements 6*a* to 6*d*, which are essentially cuboid. In this case, the guide elements 6*a* and 6*d* are fitted on an annular element 9, which surrounds the bolt 16 and has a projection 34, which is used for positioning of the angled element 28 and of the compression spring 8. The guide elements 6*b* and 6*c* are located on the spring mount 7.

The interrupter assembly is held, as shown in FIG. 2, in an enclosure 4 with a removable cover 11. The cover 11 has a cutout 30, through which the indicator 10 of the annular element 9 can be seen. This allows the movement of the indicator 10 to be seen during movement of the loose bearing 2, so that, when the enclosure 4 is closed with the cover 11 fitted, the position of the indicator 10 in the cutout 30 allows the operator to see the switching state of the vacuum contactor (open/closed).

The arrangement of the interrupter assembly in an inner chamber in the enclosure 4 between the enclosure walls 31 and 32 can be seen from FIG. 3. The vacuum contactor is covered from above by the cover 11.

The guide elements 6*a* and 6*d* of the annular element 9 are guided in the grooves 5*a* and 5*b*, which are formed by interaction of the recesses 12*a* and 12*b* in the enclosure walls 31 and 32 with the contact surfaces 13*a* and 13*b* of the cover 11, when the cover 11 is fitted. Thus, when the cover 11 is removed, the loose bearing 2 is conveniently accessible, for example for replacement.

The grooves 5*a* and 5*b* may also be formed by recesses which are located completely in the enclosure walls 31 and 32, or by a recess on the cover 11, which interacts with a contact surface in the enclosure 4 (not shown).

FIG. 3 also shows the contact support 25 with the lever element 29 held on it. The contact support 25 is moved in the movement direction 26 via a magnet system, which is not shown. at least the other of the housing of the vacuum contactor and a cover of the vacuum contactor.

The guide elements 6*b* and 6*c* are advantageously guided in the associated grooves 5 (or groove regions) with more play than the guide elements 6*a* and 6*d* in their associated grooves 5 (or groove regions), in order to allow the bolt 16 to tilt slightly during closing and opening of the loose bearing 2, owing to the rotary movement of the lever 23 about the bearing element 24 (not shown).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vacuum contactor, comprising:

a stationary contact; and a movable contact, movable to produce an electrically conductive connection, wherein the movable contact is connected to an enclosure of the vacuum contactor such that it can be moved; and a bellows element, located between the stationary contact and the movable contact, wherein the movable contact includes at least one guide element, movable in a groove in the enclosure, the groove being formed by interaction of at least one recess in at least one of the enclosure and a cover of the enclosure, and at least one contact surface on at least the other of the enclosure and cover of the enclosure, and wherein the at least one guide element is fitted on an annular element of the movable contact of the vacuum contactor, wherein the annular element is fitted adjacent to the bellows element, and wherein the annular element includes a projection for positioning of an angled element for fitting a flexible strip on the movable contact.

2. The vacuum contactor as claimed in claim 1, wherein an indicator for indicating movement position of the movable contact, is fitted on the annular element.

3. The vacuum contactor as claimed in claim 1, wherein the at least one guide element is essentially cuboid.

4. The vacuum contactor as claimed in claim 1, wherein the at least one guide element includes at least one of plastic and a plastic coating.

5. The vacuum contactor as claimed in claim 1, wherein the at least one guide element includes opposing guide elements.

6. The vacuum contactor as claimed in claim 1, wherein the at east one guide element is in the form of a depression in the enclosure.

7. The vacuum contactor as claimed in claim 1, wherein the at least one guide element is formed by a recess on the cover and on a contact surface in the enclosure.

8. The vacuum contactor of claim 1, wherein the movable contact includes a loose bearing.

9. The vacuum contactor of claim 1, wherein the groove is formed by interaction of at least one recess in the enclosure and at least one contact surface of the cover, when the cover is on the enclosure.

10. A three phase motor, comprising the vacuum contactor of claim 1.

11. The vacuum contactor of claim 1, wherein the groove is formed by interaction of at least one recess in the cover and at least one contact surface of the enclosure, when the cover is on the enclosure.

12. A vacuum contactor, comprising:

a stationary contact; and a movable contact, displaceable to establish an electrically conductive connection, wherein the movable contact includes at least one guide element, movable in a groove formed by at least one recess in at least one of a housing of the vacuum contactor and a cover of the vacuum contactor, and at least one contact surface on at least the other of the housing of the vacuum contactor and a cover of the vacuum contactor a cover of the housing, and wherein an annular element of the movable contact includes a projection for positioning of an angled element for fitting a flexible strip on the movable contact.

13. The vacuum contactor as claimed in claim 12, wherein the at least one guide element is fitted on a spring mount of a compression spring of the movable contact of the vacuum contactor.

14. The vacuum contactor as claimed in claims 13, wherein the at least one guide element is fitted on an annular element of the movable contact of the vacuum contactor, wherein the annular element is fitted adjacent to a bellows element.

15. The vacuum contactor as claimed in claim 14, wherein an indicator for indicating movement position of the movable contact, is fitted on the annular element.

16. The vacuum.-contactor as claimed in claim 12, wherein the at least one guide element is fitted on an annular element of the movable contact of the vacuum contactor.

17. The vacuum contactor as claimed in claim 12, wherein an indicator for indicating movement position of the movable contact, is fitted on the annular element.

18. The vacuum contactor as claimed in claim 12, wherein the at least one guide element is essentially cuboid.

19. The vacuum contactor as claimed in claim 12, wherein the at least one guide element includes at least one of plastic and a plastic coating.

20. The vacuum contactor as claimed in claim 12, wherein the at least one guide element is in the form of a depression in the housing.

21. The vacuum contactor as claimed in claim 12, wherein the at least one guide element is formed by a recess on the cover and on a contact surface in the housing.

22. The vacuum contactor of claim 12, further comprising: a bellows element, located between the stationary contact and the movable contact.

23. The vacuum contactor as claimed in claim 22, wherein the at least one guide element is fitted on an annular element of the movable contact of the vacuum contactor, wherein the annular element is fitted adjacent to the bellows element.

24. The vacuum contactor as claimed in claim 22, wherein the at least one guide element includes opposing guide elements.

25. The vacuum contactor as claimed in claim 23, wherein the at least one guide element includes opposing guide elements.

26. The vacuum contactor of claim 12, wherein the movable contact includes a loose bearing.

27. The vacuum contactor of claim 22, wherein the movable contact includes a loose bearing.

28. The vacuum contactor of claim 12, wherein the groove is formed by interaction of at least one recess in the housing and at least one contact surface of the cover, when the cover is on the housing.

29. The vacuum contactor of claim 22, wherein the groove is formed by interaction of at least one recess in the housing and at least one contact surface of the cover, when the cover is on the housing.

30. A three phase motor, comprising the vacuum contactor of claim 12.

31. A three phase motor, comprising the vacuum contactor of claim 22.

32. The vacuum contactor of claim 12, wherein the groove is formed by interaction of at least one recess in the cover and at least one contact surface of the housing, when the cover is on the housing.

33. The vacuum contactor of claim 22, wherein the groove is formed by interaction of at least one recess in the cover and at least one contact surface of the housing, when the cover is on the housing.

34. A vacuum contactor, comprising:

a stationary contact: and a movable contact, displaceable to establish an electrically conductive connection, wherein the movable contact includes at least one guide element, movable in a groove formed by at least one recess in at least one of a housing of the vacuum contactor and a cover of the vacuum contactor, and at least one contact surface on at least the other of the housing of the vacuum contactor and a cover of the vacuum contactor. wherein the at least one guide element includes opposing guide elements.

35. The vacuum contactor as claimed in claim 34, wherein the at least one guide element is essentially cuboid.

36. The vacuum contactor as claimed in claim 34, wherein the at least one guide element includes at least one of plastic and a plastic coating.

37. The vacuum contactor as claimed in claim 34, wherein the at least one guide element is in the form of a depression in the enclosure.

38. The vacuum contactor as claimed in claim 34, wherein the at least one guide element is formed by a recess on the cover and on a contact surface in an enclosure.

39. A three phase motor, comprising the vacuum contactor of claim 34.

40. The vacuum contactor of claim 34, wherein the groove is formed by interaction of at least one recess in an enclosure and at least one contact surface of the cover, when the cover is on an enclosure.

41. The vacuum contactor of claim 34, wherein the groove is formed by interaction of at least one recess in the cover and at least one contact surface of the enclosure, when the cover is on the enclosure.

* * * * *